US010137680B2

(12) United States Patent
Meuleman et al.

(10) Patent No.: US 10,137,680 B2
(45) Date of Patent: Nov. 27, 2018

(54) PRINTING SYSTEM HAVING INDIVIDUALLY MOVABLE SUB-DETECTOR ELEMENTS FOR PRINT HEAD PROTECTION

(71) Applicant: SPGPrints B.V., Boxmeer (NL)

(72) Inventors: Peter Klein Meuleman, Venlo (NL); Sjef Kusters, Boxmeer (NL)

(73) Assignee: SPGPrints B.V., Boxmeer (NL)

( * ) Notice: Subject to any disclaimer, the term of this patent is extended or adjusted under 35 U.S.C. 154(b) by 0 days.

(21) Appl. No.: 15/456,995

(22) Filed: Mar. 13, 2017

(65) Prior Publication Data

US 2018/0257370 A1 Sep. 13, 2018

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS

2005/0151773 A1* 7/2005 Watarai ..... B41J 3/4078 347/16
2013/0070021 A1* 3/2013 Nishimura ..... B41J 25/34 347/37
2014/0292890 A1* 10/2014 Tokai ..... B41J 2/01 347/19

FOREIGN PATENT DOCUMENTS

WO 2011/157282 A1 12/2011

* cited by examiner

*Primary Examiner* — Jason Uhlenhake
(74) *Attorney, Agent, or Firm* — Hoffmann & Baron, LLP

(57) ABSTRACT

A printing system includes a print module with printheads covering a printing width in x-direction, and a substrate holder for supporting a substrate. The substrate and print module are movable relative to each other in y-direction. Each printhead is positioned spaced at a first distance from the substrate holder in z-direction. A detection mechanism is provided for detecting obstructions on the substrate holder. A control unit is provided for stopping further relative movement in the y-direction between the substrate and the print module when an obstruction has been detected. The detection mechanism includes individually movable sub-detection elements that together cover the printing width, where those elements are designed to have a detection signal send out to the control unit when one of the elements gets moved out of a starting position by an obstruction trying to pass it.

16 Claims, 9 Drawing Sheets

PRINTING SYSTEM HAVING INDIVIDUALLY MOVABLE SUB-DETECTOR ELEMENTS FOR PRINT HEAD PROTECTION

FIELD OF THE INVENTION

The invention relates to a printing system that is equipped with a detection mechanism for protection of printheads against damaging or even crashes that may be caused by obstructions, like crumples in a substrate to be printed, that might be too thick to pass underneath the printheads during a printing operation.

BACKGROUND OF THE INVENTION

From the state of the art numerous printing systems are known that, especially in industrial environments, often include some kind of automatic detection mechanism for detecting such obstructions and thus being able to properly protect the vulnerable and expensive printheads during operation.

For example, single pass printing systems are known in which a plurality of print modules with print heads are placed next to each other such that they together cover a printing width in a transverse direction. During a printing operation, a substrate is moved stepwise underneath the print heads while being printed by them. In front of the print modules, a detection mechanism is placed. The detection mechanism comprises a plurality of light transmitters and a plurality of light sensors that are positioned at opposing transverse sides of the substrate. The light transmitters are positioned and directed such that they are able to transmit light beams closely above the substrate during operation. When one or more of the light beams gets blocked by an obstruction that projects upwardly from the substrate, like for example a crumple in the substrate, then this causes the light sensors to sense shadow. A detection signal is then sent out to a control unit that immediately stops the printing operation. The substrate no longer gets moved further towards the printheads, and thus the obstruction is prevented from running against one or more of the printheads.

A disadvantage with this is that the functioning of the detection mechanism leaves to be improved. Sometimes it occurs that the printing operation is stopped although no obstruction is present on top of the substrate. This may be caused by temperature changes, in which expansion of the light transmitters or sensors or their mounting means may occur and because of which a breaking index above the substrate may change due to air temperature changes. This may lead to the light beams getting somewhat redirected and thus getting oriented to close above the substrate with the risk of running partly against the substrate, causing shadow on the light sensors and unnecessarily stopping the printing operation. Even worse it may also occur that because of temperature changes the light beams get oriented too far above the substrate. This may lead to a situation in which the light beams pass over an obstruction without being interrupted by it at all. The printing operation then does not get stopped at all with the effect that the printheads may get damaged by such an undetected obstruction. Another disadvantage is that it is difficult to accurately adjust the light beams and sensors relative to each other and relative to the substrate, in particular when large printing widths of several meters need to be covered. Yet another disadvantage is that the detection mechanism requires free space at the opposing transverse sides of the substrate at the level of the substrate itself.

Scanning printing systems are also known to be equipped with a detection mechanism. In such a scanning printing system a plurality of print modules are placed in a carriage that is movable back and forth in a transverse direction over a substrate during a printing operation. Mechanically operable detection mechanism may be connected to opposing carriage sides that face the transverse direction. Those detection mechanisms thus move along with the carriage back and forth in the transverse direction during a printing operation. Because of that it is not possible to use light transmitters that get positioned so close to the substrate that they are able to transmit their light beams closely above the substrate during operation. Instead, an elongate plate is known to be used as detection element. The plate extends over the entire printing width and is hingedly connected to its respective side of the carriage while hanging downwards at a height above the substrate that is smaller than the spacing between the printheads and the substrate. End switches are positioned adjacent to the plate such that a swinging movement of the plate operates the switches. Such a swinging movement of the plate can be caused by the plate running against an obstruction on top of the substrate. A detection signal then is sent out to a control unit that immediately stops the printing operation. The carriage does not get moved further in the transverse direction over the substrate, and thus the obstruction is prevented from running against one or more of the printheads. Instead of end switches positioned adjacent the plate, it is also possible to have the plate itself connected to movable parts of switches, or to provide photo electric sensors adjacent the plate that get activated by a swinging movement thereof.

A disadvantage with this is that the high acceleration and deceleration forces that get exerted on the carriage during its high speed back and forth movements over the substrate, may accidentally induce a swinging movement of the plate and thus stop a printing operation without an obstruction being actually detected. On the other hand it has also occurred that the plate, instead of being pushed away by an obstruction, started to press the obstruction into the substrate and thus damage the substrate, instead of sending out a detection signal towards the control unit that an emergency stop needed to be performed. With this it is noted that all kinds of measures have been taken in order to decrease the weight of the plate. This however increased the risk of the plate starting to buckle when bumping against an obstruction, which buckling in turn stiffened the plate and thus increased the risk for malfunctioning of the detection mechanism.

SUMMARY OF THE INVENTION

The present invention aims to overcome those disadvantages at least partly or to provide a usable alternative. In particular the present invention aims to provide a user-friendly and improved printing system that allows proper protection of the vulnerable and expensive print heads against damaging or crashes of obstructions against them.

This object is achieved by a printing system according to the present invention. The printing system comprises a print module with one or more printheads covering a printing width in an x-direction, and a substrate holder for supporting a substrate to be printed on by the print module. The substrate and print module are movable relative to each other in an y-direction that is perpendicular to the x-direction. Each printhead, in a print position, is positioned spaced at a first distance from the substrate holder in a z-direction that is perpendicular to the x- and y-direction. A detection mechanism is provided for detecting obstructions on the substrate holder, like crumples in the substrate. The detection mechanism comprises a detection element that extends along the printing width, and that, in the print position, is positioned spaced at a second distance from the substrate holder in the z-direction, which second distance is smaller than the first distance. A control unit is provided for stopping further relative movement in the y-direction between the substrate and the print module when an obstruction has been detected by the detection mechanism. According to the inventive thought the detection element of the detection mechanism comprises at least a first set of individually movable sub-detection elements that together cover the printing width in the x-direction, wherein the individually movable sub-detection elements are designed to have a detection signal send out to the control unit when one or more of the sub-detection elements get moved out of a starting position by an obstruction trying to pass them.

Advantageously with the individually movable sub-detection elements it has proven possible to more reliable and quickly detect obstructions. No matter how small or lightweight the obstructions may be, they are well able to push away only one of the sub-detection elements such that a signal can get forwarded to the control unit for having it immediately perform an emergency stop. Each of the sub-detection elements can easily be made lightweight enough for achieving this. When used in a scanning printing system, neither one the individually operable sub-detection elements has to get accidentally operated by means of acceleration or deceleration forces getting exerted onto them. Also one does not have to be afraid that an obstruction might get pushed into the substrate by one of the sub-detection elements. The individually moveable sub-detection elements can easily be optimized with respect to weight and dimension for achieving this. Making them heavy enough or having a spring or the like exerting a high enough biasing force on them, shall prevent them from accidentally being moved by the acceleration or deceleration forces or by flowing of air along them during back and forth scanning movements of the carriage. Making them lightweight enough on the other hand shall prevent them from exerting too high pushing forces onto an obstruction. When used in a single-pass printing system the set of individually movable sub-detection elements can easily be made such long that it is well able to span printing widths of several meters, simply by increasing the number of individually movable sub-detection elements.

In general it is noted that the number of sub-detection elements per unit of length can easily be varied. For example between 10-20 sub-detection elements may be used per set cq printing width to be covered. In particular each sub-detection element preferably can be given a width in x-direction of between 5-40 mm.

The sub-detection elements can be positioned adjacent each other in a single row. It is however for example also possible to position them staggered in two or more rows with or without some overlap. It is also possible to provide two or more sets of the sub-detection elements, wherein each set has its sub-detection elements placed adjacent each other in the x-direction, and wherein each set is positioned at another position in y-direction relative to the other set(s).

In a preferred embodiment the individually movable sub-detection elements are formed by flexible flaps that extend in the x-z-plane and that are elastically deformable in the y-direction. This embodiment with flexible flaps can easily and economically be manufactured. No hinges or the like are necessary to have them be able to perform their movements when an obstruction needs to be detected. Instead the flexible flaps can easily be fixedly mounted to a beam that extends in the x-direction, for example by being clamped thereto.

Individual movements of one or more of the respective sub-detection elements can be detected in different ways. For example use can be made of electric circuits that get opened or closed as soon as one of the sub-detection elements gets moved out of its starting position. Also it is possible to provide dedicated own end switches for each respective sub-detection element, or to provide dedicated own photo-electric sensor means for each respective sub-detection element.

In a preferred embodiment however the detection mechanism further comprises a shared sensing organ that extends in the x-direction along at least a plurality of the individually movable sub-detection elements, and in particular along each one of them, such that the sensing organ gets activated or de-activated as soon as one or more of the sub-detection elements get moved by an obstruction trying to pass them.

In particular this shared sensing organ then may comprise a light transmitter, in particular a laser, and a light sensor, wherein the light transmitter is positioned for transmitting a light beam in the x-direction along said plurality of the individually movable sub-detection elements towards the light sensor such that the light beam gets at least partly interrupted as soon as at least one of the sub-detection elements gets moved by an obstruction trying to pass it. Thus a cost saving can be achieved as well as a saving in weight because only a limited number of sensing organs can be used.

More in particular each individually movable sub-detection element then may comprise an activating or de-activating part that projects in the y-direction and that is designed for activating or de-activating the sensing organ. This has the advantage that the sensing organ can be positioned spaced at a distance of the front faces of the sub-detection elements. When for example use is made of a light transmitter and sensor then the light beam advantageously does not have to be positioned and oriented to transmit a light beam closely along the front faces of the sub-detection elements. This makes it easier to provide for an adjustable sensing range and thus may help to prevent premature emergency stops.

For example each individually movable sub-detection element can have its activating or de-activating part formed by a part that is connected thereto such that it projects in the y-direction therefrom. In the case of a plate-shaped sub-detection element the activating or de-activating part can even be partly cut-out of the plate-shape and bent towards the y-direction. Thus an economic construction is achieved of which the activating or de-activating part can easily be varied in dimension and shape if desired.

Each activating or de-activating part may comprise a through going opening, wherein the sensing organ, in the starting positions of the sub-detection elements, extends in the x-direction through the openings of the plurality of the individually movable sub-detection elements.

In particular each activating or de-activating part may have this opening centrally (in the y-direction) provided inside it. The thus formed sideways closed openings offer the advantage that they are able to activate or de-activate the sensing organ in both a forward and backward moving direction of the individually movable sub-detection element they form part of. For example a light beam transmitted through a plurality of such openings gets interrupted both in a situation that one of the activating or de-activating parts moves forward or backward in the y-direction relative to it.

The openings may be made such that they gradually decrease in the y-direction. Thus they are able to increasingly block for example a light beam that gets transmitted through them as soon as one of the sub-detection elements gets pushed out of its starting position, forward or backward in the y-direction, by an obstruction.

The individually movable sub-detection elements can be made out of all kinds of materials. For example they can be made out of plastic, in particular polypropylene foil. In the case of using flaps as sub-detection elements, this choice of material is well able to give them a desired rigidity/flexibility/weight combination.

A height adjustment mechanism can be provided for adjusting a position in z-direction of the set of individually movable sub-detection elements relative to the substrate holder. Thus depending on the substrate to be printed, and in particular its thickness and/or surface condition, it becomes possible to quickly and easily adjust the detection mechanism such that it induces an emergency stop only when this is truly necessary. For example, when a spacing between the printheads and the substrate is a few millimeters, than the sub-detection elements can be positioned with their lower ends less than half that spacing above the substrate.

The set of the individually movable sub-detection elements is preferably provided at a side of the print module that is directed towards a direction of relative movement between the print module and the substrate, that is to say upstream of the print heads. Thus an obstruction gets noticed before it gets to bump against the print heads.

In a scanning printing system the print module is placed on a carriage that is movable back and forth in the y-direction along the substrate holder during printing of a substrate. The first set of the individually movable sub-detection elements then can be provided at a first one of the transverse sides of the carriage that extends in the x-direction, whereas a second set of the individually movable sub-detection elements then can be provided at the second opposing transverse side of the carriage that extends in the x-direction.

The carriage, which thus may weigh more than 100 kilograms, preferably comprises a plurality of print modules next to each other in the y-direction, in particular each destined for printing a different colour, wherein each print module may be equipped with a number of the printheads that are positioned adjacent each other in the x-direction. The invention makes it advantageously possible to provide the relative heavy carriage with suitable sets of individually moveable sub-detection elements for timely detection of obstacles that may crash against the large number of printheads in the carriage.

Further preferred embodiments are stated in the subclaims.

BRIEF DESCRIPTION OF THE DRAWINGS

The invention will now be described in further detail below in a non-limiting way by reference to the accompanying drawings in which.

DETAILED DESCRIPTION OF THE INVENTION

Figure 1:
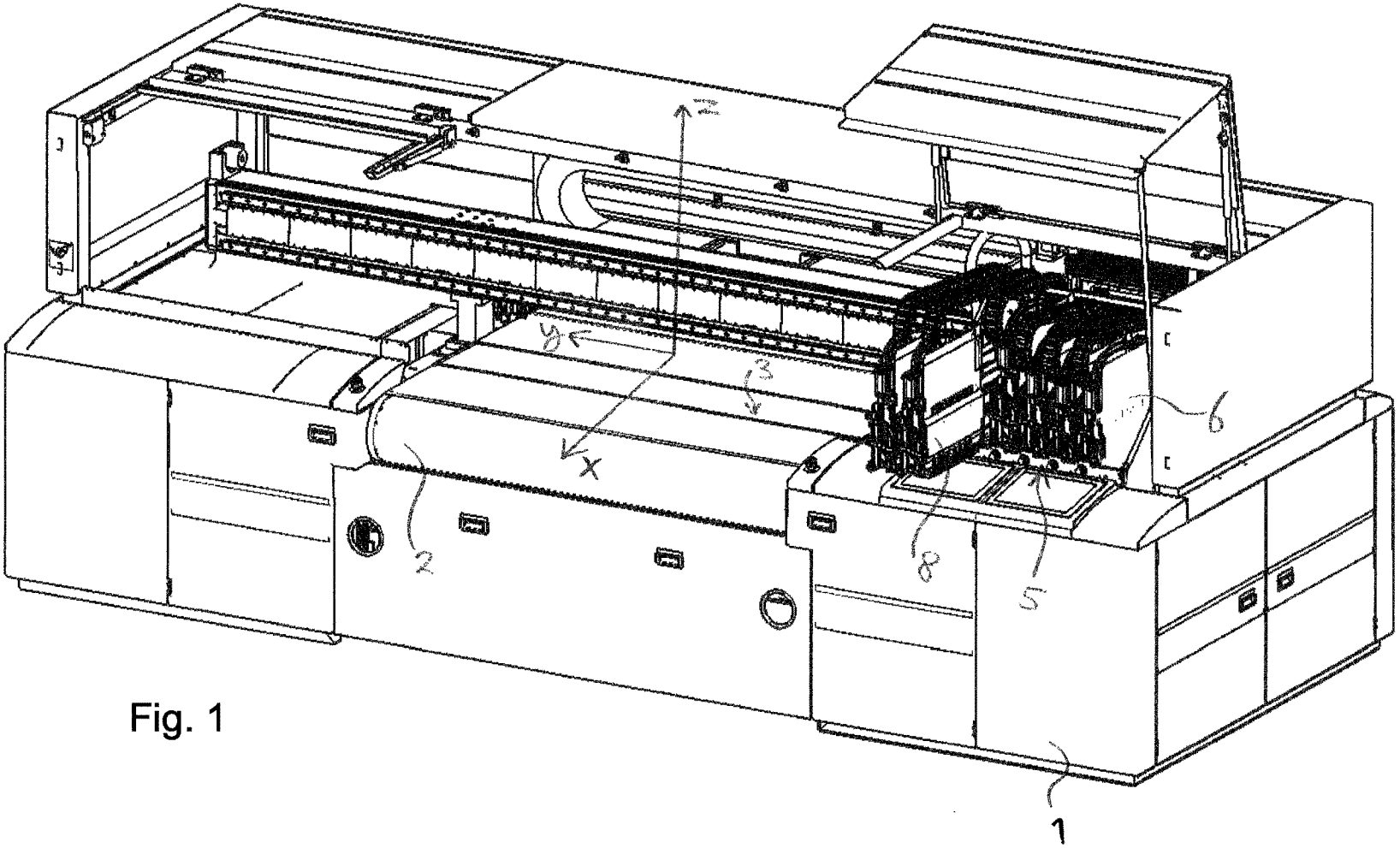
FIG. 1 shows a schematic perspective view of a scanning type printing system.

In FIG. 1 a scanning printing system is shown which has a main frame 1 that can be placed on the ground. The system comprises an operable conveyor belt as substrate holder 2 that is designed for supporting, holding and transporting a substrate 3 to be printed on. The substrate 3 is supported in a horizontal plane by the substrate holder 2 and can be moved by it in a transportation direction x. A sub-frame 5 forms a carriage 6 that is reciprocatingly movable in a transverse scanning direction y relative to the main frame 1 and the substrate 3. The x- and y-directions are perpendicular to each other. The carriage 6 holds six print modules 8 that are positioned adjacent each other in the y-direction. Each print module 8 is connected via a flexible duct to its own ink reservoir that is filled with its own distinctive colour and that is provided on the main frame 1. The print modules 8 are individually movable up and down in a vertical displacement direction z that is perpendicular to the x- and y-directions. Thus the print modules 8 can be moved towards and away accurately aligned print positions (as shown in the drawings) and maintenance positions (not shown) where they are easily accessible for having maintenance performed thereto. Each print module 8 comprises a number of printheads that in a print position each are positioned spaced at a first distance z1 from the substrate 3 on the substrate holder 2 in the z-direction. See FIG. 8.

Figure 2:
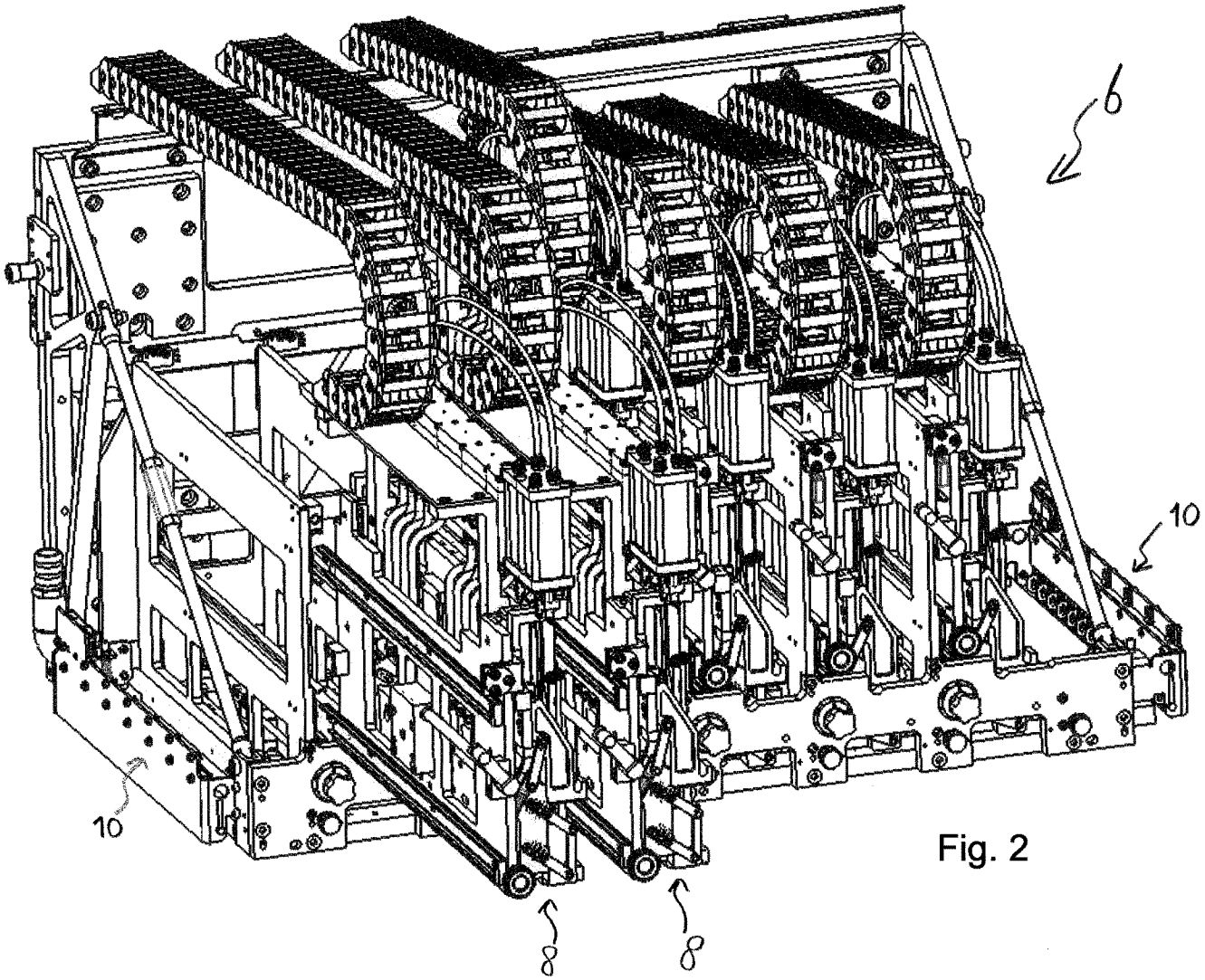
FIG. 2 shows a cut-away view of the carriage of FIG. 1 with detection mechanisms at opposing transverse sides of a set of print modules.
Figure 3:
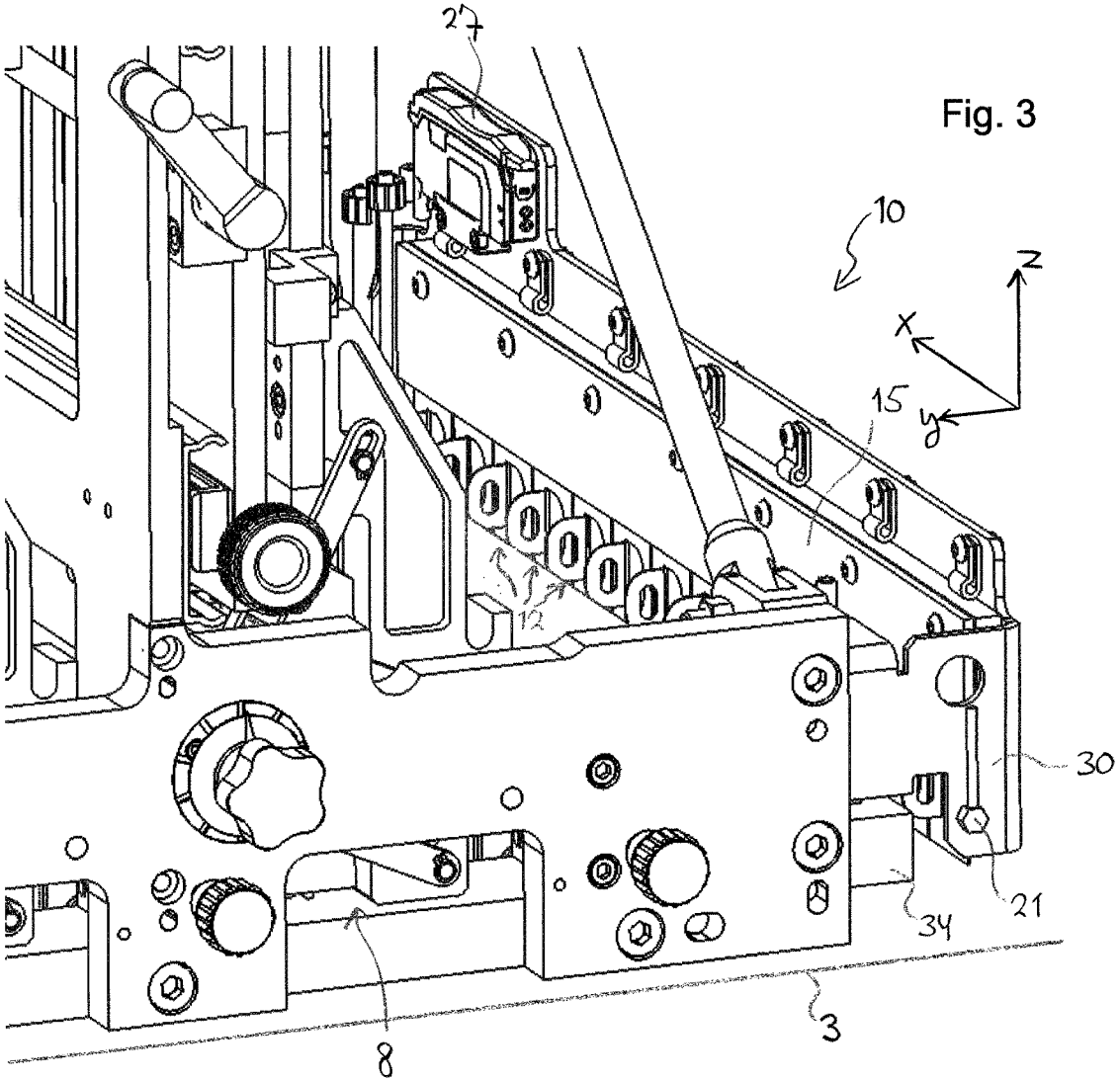
FIG. 3 shows an enlarged partial view of FIG. 2.
Figure 5:
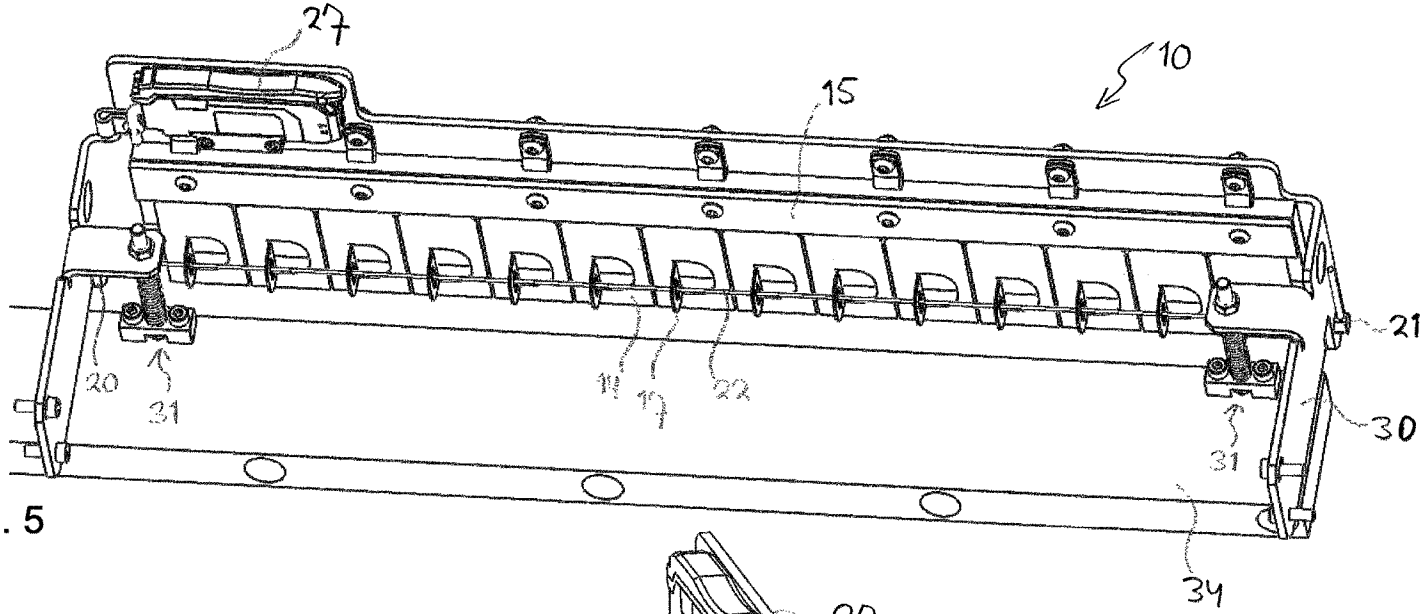
FIG. 5 shows a perspective top view of FIG. 3.
Figure 4:
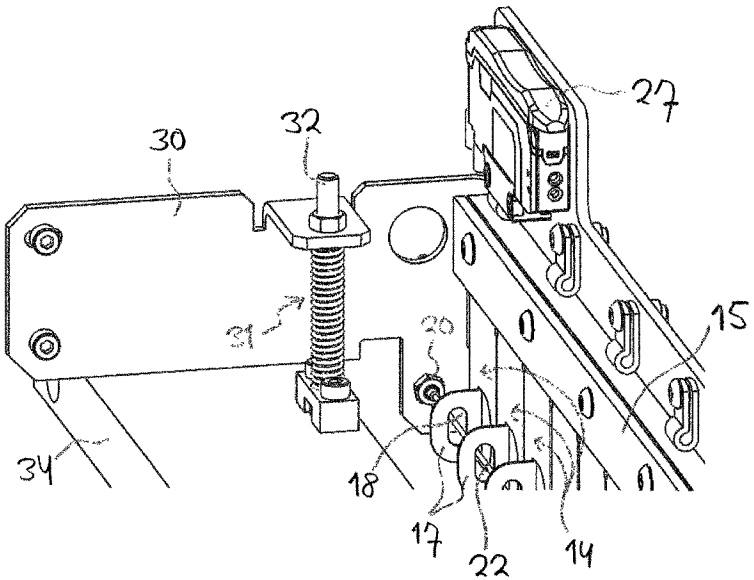
FIG. 4 shows a further enlarged partial view of FIG. 3.

In FIG. 2 it can be seen that the carriage 6 at both of its transverse sides is provided with a detection mechanism 10 according to the invention. As can be seen in FIGS. 3-5, each detection mechanism 10 comprises a large number, here fourteen in total, of individually movable sub-detection elements 12.

Each sub-detection element 12 is formed by a plate-shaped flap 14 that extends downwardly from a beam 15. Lower ends of each flap 14 are positioned spaced at a second distance z2 from the substrate 3 on the substrate holder 2 in the z-direction. See FIG. 8. The beam 15 extends along the entire printing width in x-direction of the plurality of printheads in the print modules 8. The flaps 14 are positioned next to each other and together also cover the entire printing width in x-direction. The flaps 14 are flexible such that they are elastically deformable back and forth in the y-direction relative to the beam 15. Each flap 14 here has been designed with a width of between 25-35 mm, in particular about 30 mm. Furthermore each flap 14 has a thickness of between 0.5-1.0 mm, in particular about 0.7 mm.

Each flap 14 comprises an ear-shaped activating or de-activating part 17 that has been partly cut free out of its flap 14 and that has been bent in the y-direction such that is positioned perpendicular to the rest of the flap 14. Inside the part 17 a central opening 18 is left free. The part 17 in particular projects at least 10 mm in the y-direction.

At the outer ends of the row of flaps 14, a light transmitter 20 and a light sensor 21 are provided. The light transmitter 20 is positioned and directed such that it is able to transmit a light beam 22 along the plurality of flaps 14 through the plurality of openings 16 towards the light sensor 21. The opening 18 has a width in the y-direction that is preferably larger than a cross-section of the light beam 22, for example a width of about 5 mm.

During a printing operation the carriage 6 gets to perform scanning movements back and forth in the y-direction over the substrate 3. If during such a scanning movement in the y-direction, the carriage 6 comes across an obstruction 25 that is present on the substrate 3 (see FIGS. 6A-C and 7A-C), then this obstruction 25 shall first be seen by that one of the detection mechanisms 10 that at that moment faces towards the direction that the carriage 6 is moving towards. See FIGS. 6A and 7A.

The obstruction 25 shall immediately start to exert a pushing force onto one of the flaps 14 of that front side detection mechanism 10, as soon as the flap 14 that lies in line with the obstruction 25 tries to pass over it. See FIGS. 6B and 7B. Because of this that respective flap 14 shall be forced to bend backwards. With this the ear-shaped activating or de-activating part 17 of that flap 14 shall start to increasingly block the light beam 22. This causes shadow on the light sensor 21, which then shall immediately sent out a signal to a control unit 27. The control unit 27 then shall take action that the scanning movement of the carriage 6 is immediately stopped and thus performs an emergency stop before the obstruction 25 is able to crash against lower sides of the print heads of the print modules 8.

Figure 6C:
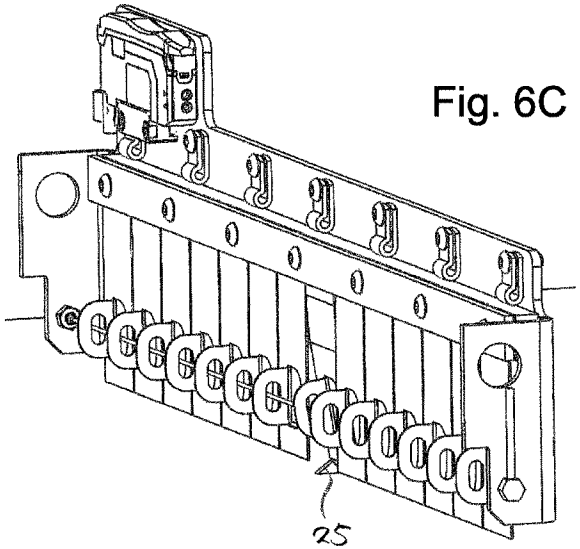
FIGS. 6A, 6B, 6C show three stages of detection of an obstruction by the detection mechanism.
Figure 6B:
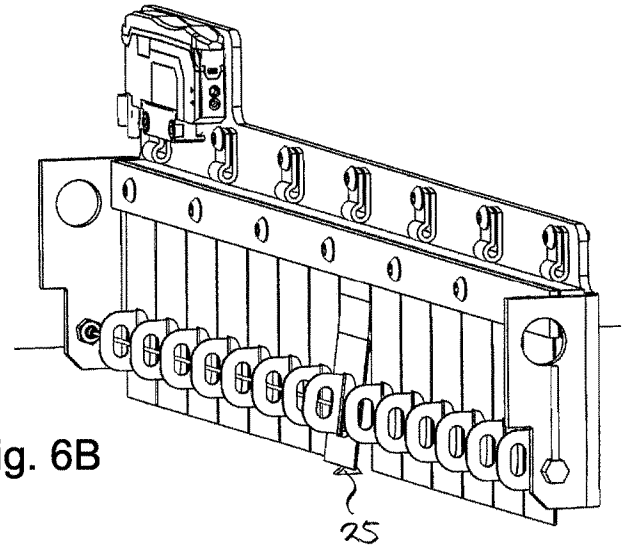
Figure 6A:
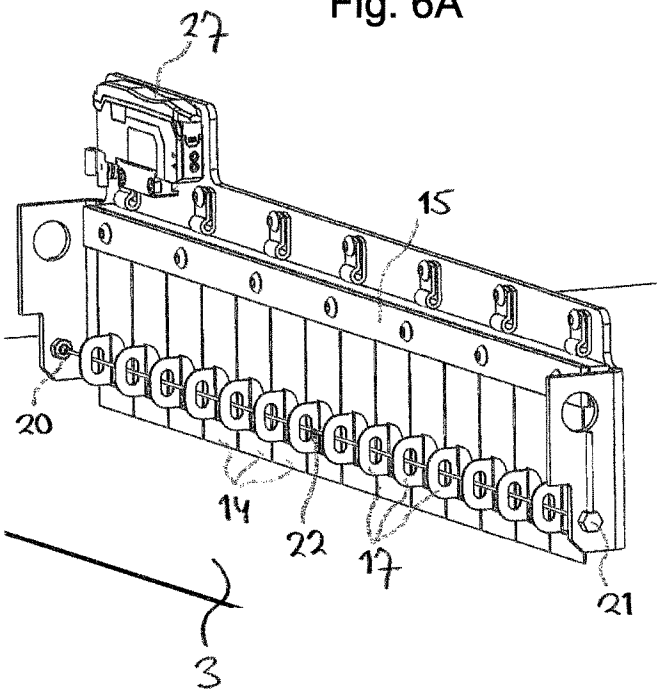
Figure 7C:
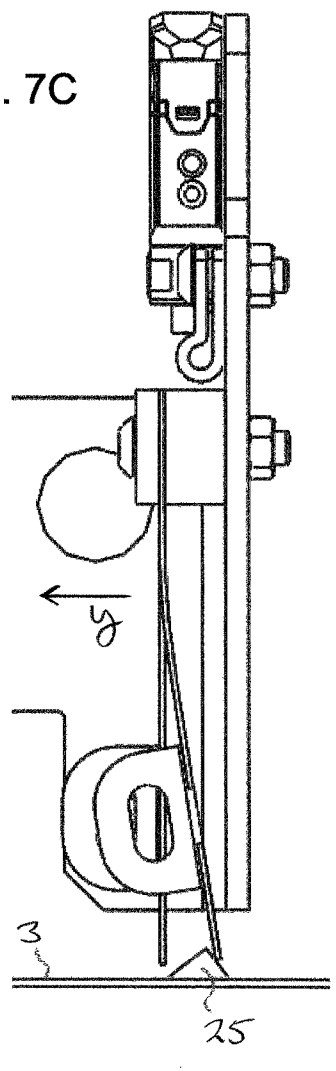
FIGS. 7A, 7B, 7C show sectional side views of FIGS. 6A, 6B, 6C, respectively.
Figure 7B:
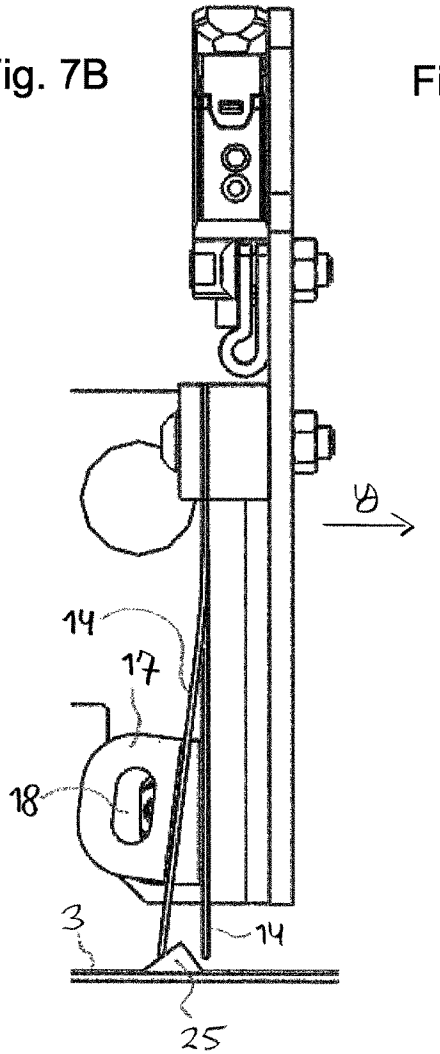

As FIGS. 6C and 7C show, the flaps 14 advantageously also are able to block the light beam 22 when they are forced to bend in the opposite direction, which may occur when the carriage 6 is moved in the opposite direction. During a printing operation this however shall normally not occur, because then this obstruction is first seen by the other detection mechanism that at that moment faces towards the direction that the carriage 6 is moving towards.

Each detection mechanism 10 comprises a sub-frame 30 to which the beam 15, the light transmitter 20 and the light sensor 21 are fixedly connected. At opposing sides of the sub-frame 30, a left and right height adjustment mechanism 31 is provided. The height adjustment mechanism 31 here comprises a spring biased linear guiding bar 32 of which the operable length can be changed such that the sub-frame 30 gets adjusted in height in the z-direction relative to a frame part 34 of the carriage 6. It is also possible to adjust only the left or right height adjustment mechanism 31 in order to adjust the angular orientation of the detection mechanism 10 relative to the carriage 6. In this way the height position and angular orientation of the detection mechanism 10 can be accurately tuned relative to the substrate 3 to be printed.

Figure 7A:
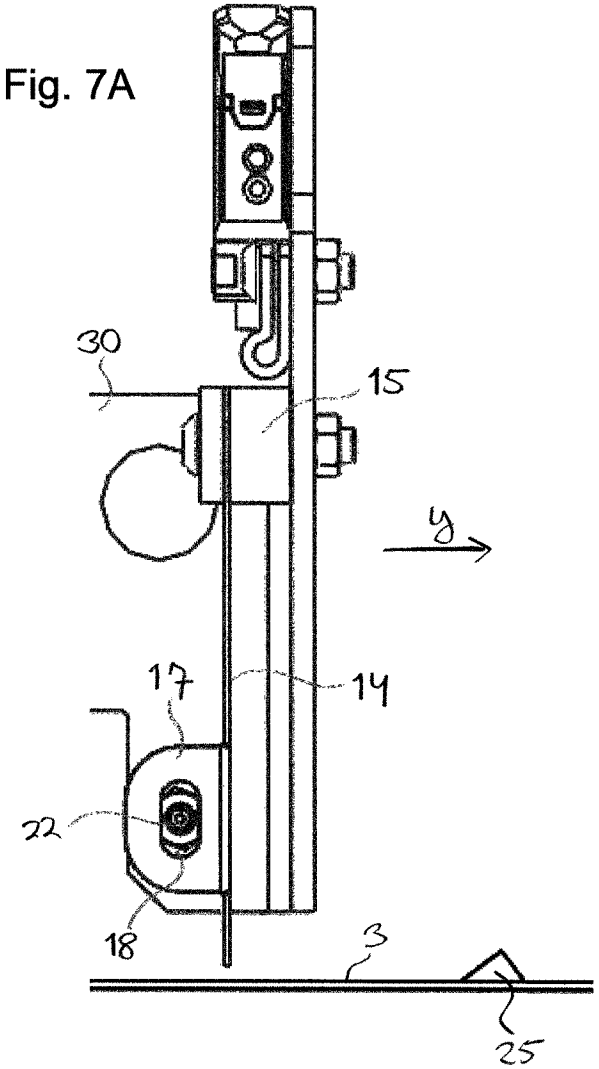
Figure 8:
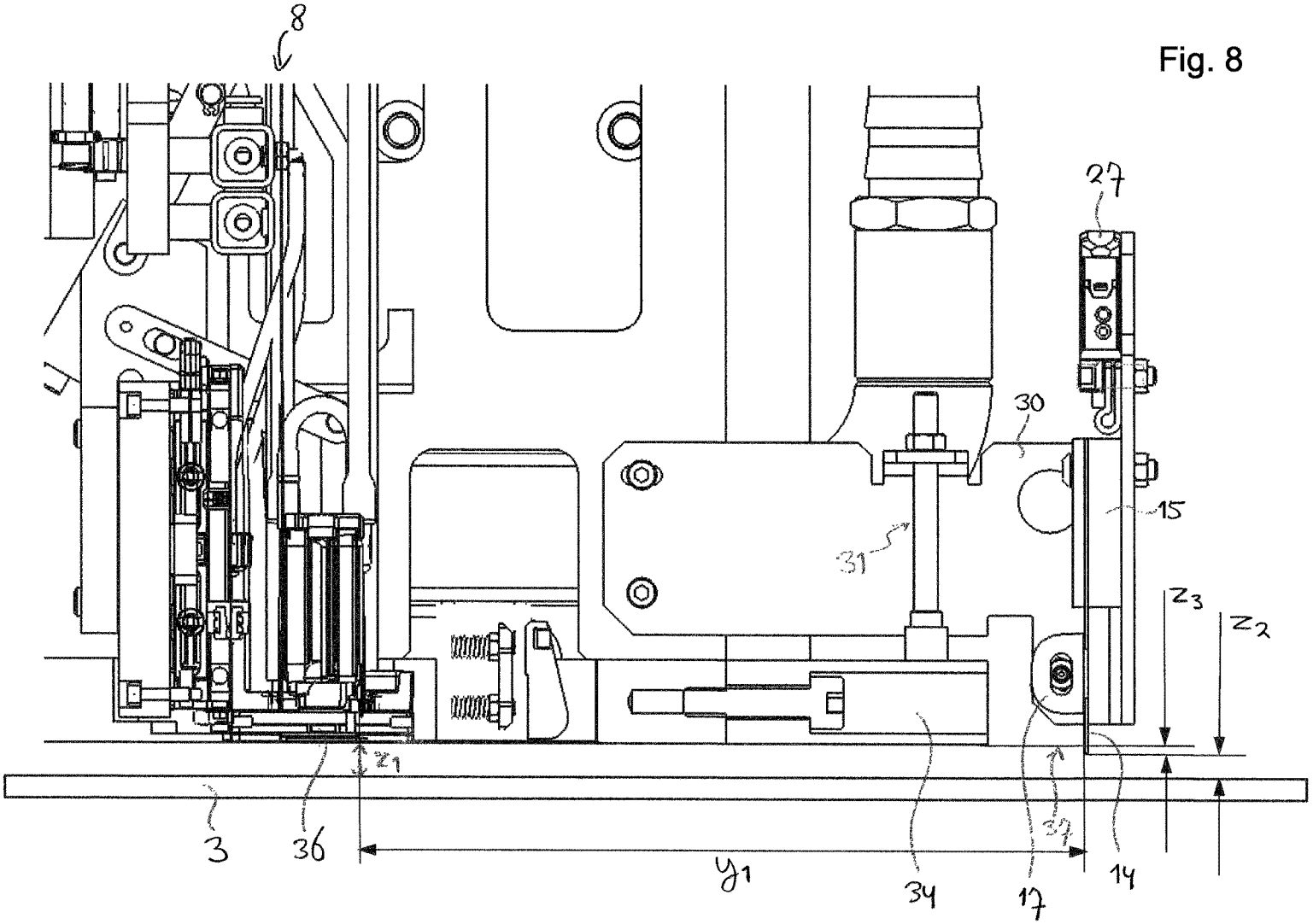
FIG. 8 shows a cross-sectional side view of FIG. 3.
Figure 9B:
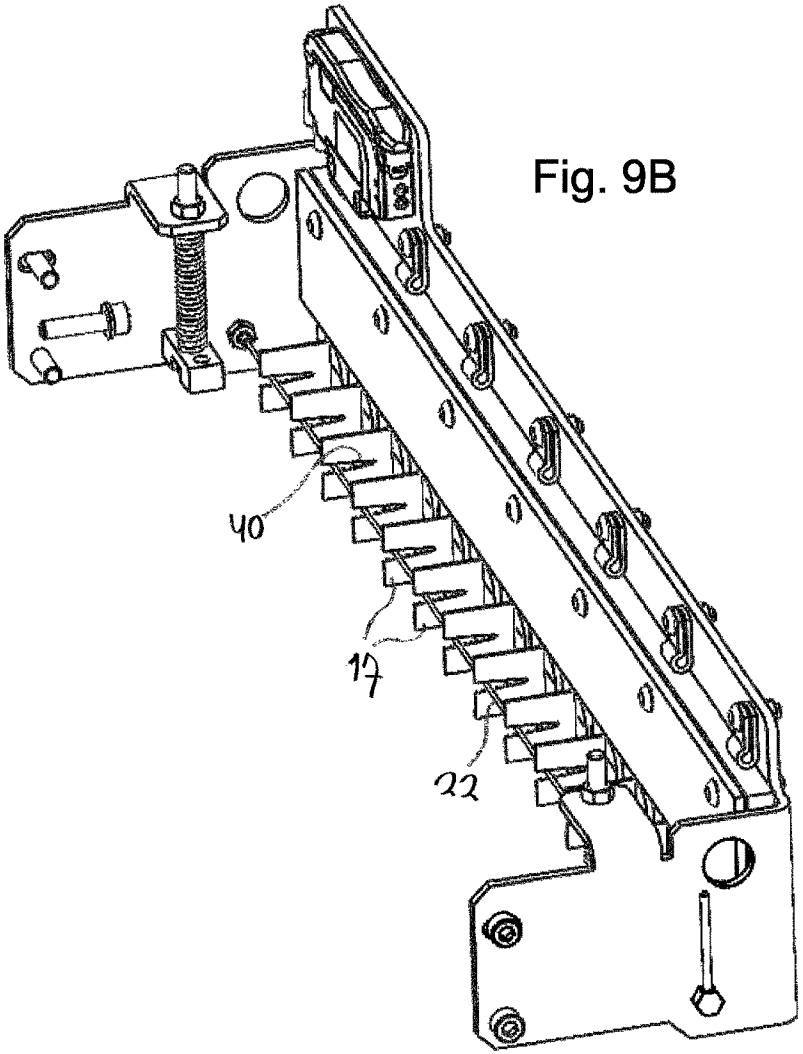
FIGS. 9A and 9B show views with and without a sub-frame part of a carriage according to FIG. 3 of a variant with proportionally varying openings.
Figure 9A:
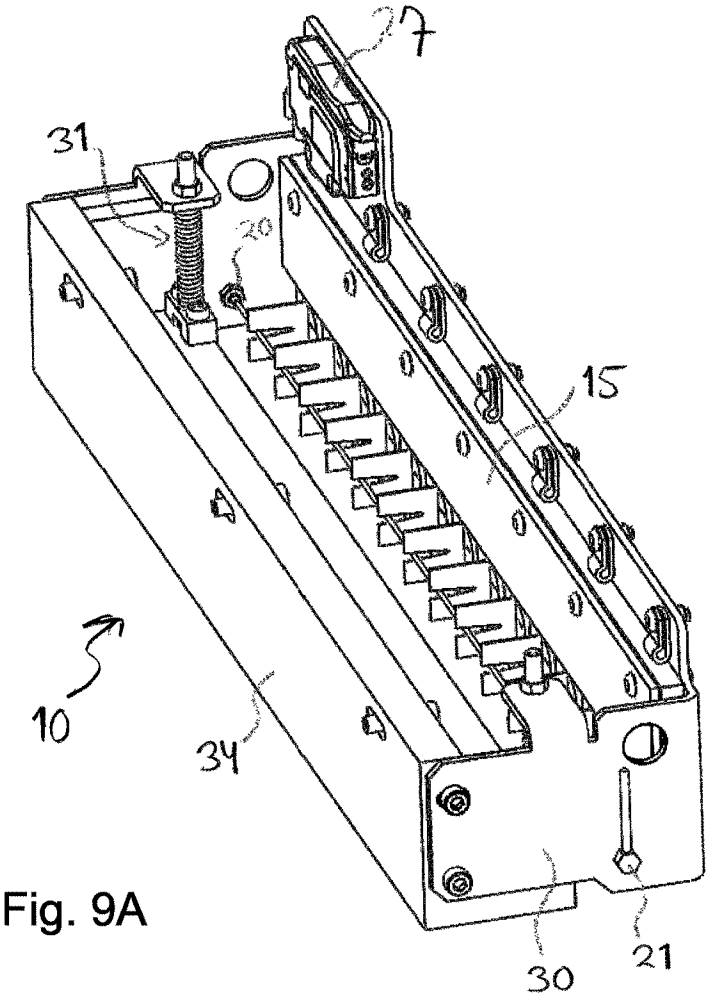
Figure 10B:
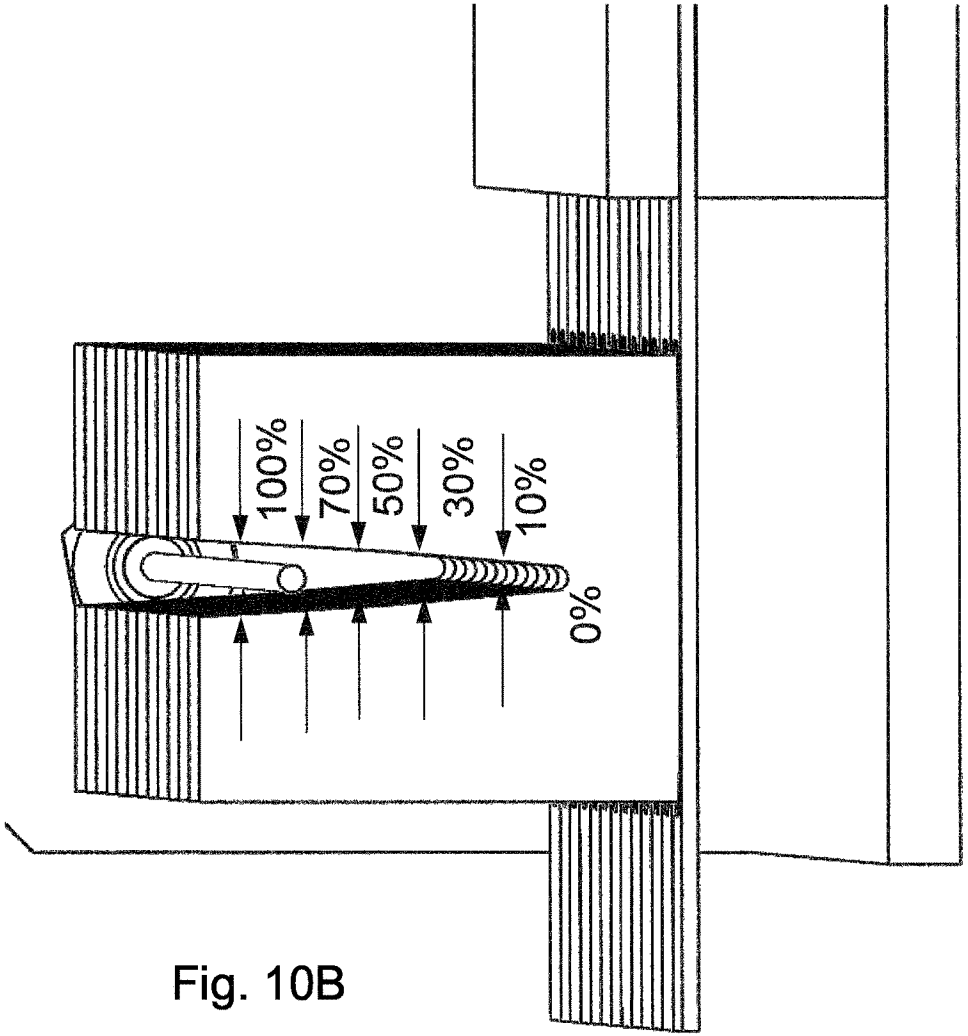
FIGS. 10A and 10B show an enlarged view of FIG. 9.
Figure 10A:
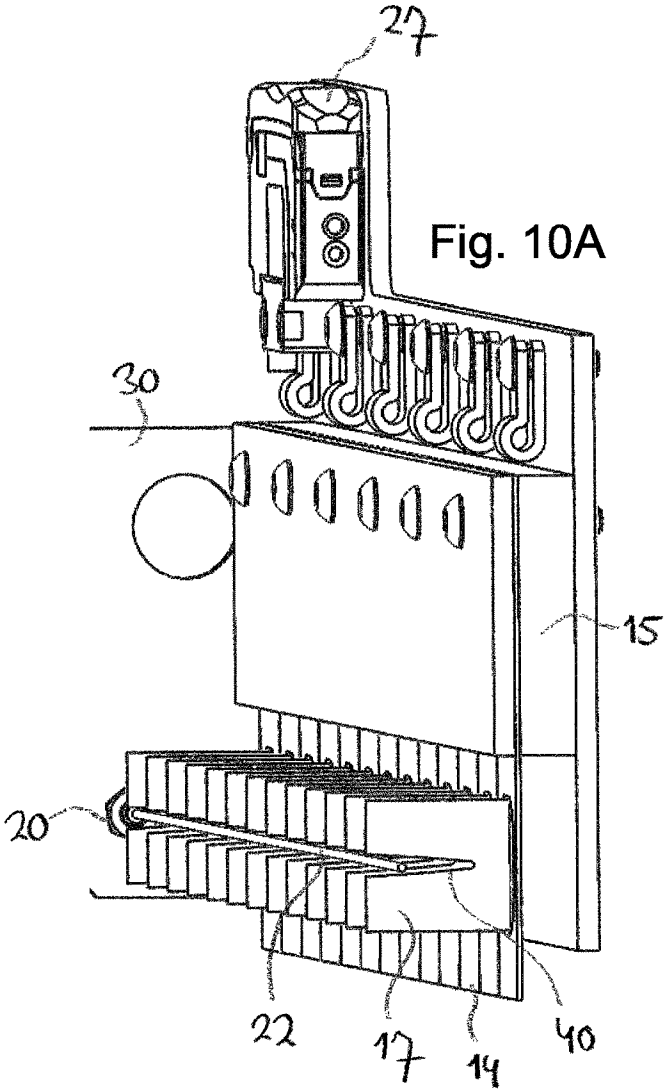

In FIG. 8 the distance z1 between the lower sides of print heads 36 of the print module 8 and the substrate 3 is schematically shown. For the situation shown here, the height of the mechanism 10 has been adjusted such that the lower ends of the print heads 36 substantially have come to lie at a same level as a lower edge 37 of the sub-frame 30. Furthermore in this FIG. 7A the distance z2 is shown between the lower edges of the flaps 14 and the substrate 3. The distance z2 in the situation shown in FIG. 7A is less than the distance z1, in particular about 1 mm. This is indicated with z3. If desired the distance z2, and thus also the distance z3, can easily be made larger or smaller by operation of the height adjustment mechanism 31. This can for example be necessary if a thicker or thinner substrate 3 needs to be printed.

In FIG. 8 it is further shown that the flaps 14 of the detection mechanism 10 lie at a distance y1 of the print heads 36. This distance y1 is needed for reaction time and to decelerate the carriage to perform the emergency stop as soon as an obstacle is detected.

In FIGS. 9A-B and 10A-B a variant of the flaps 14 is shown. Their activating or de-activating parts 17 here comprise slit-shaped openings 40 that extend in the y-direction while gradually tapering in the z-direction. This has the effect that the light beam 22 that during operation is transmitted through the openings 40, gets blocked in an increasing manner when one of the flaps 14 starts to move in the y-direction by means of passing over an obstruction 25 that is present on or forms part of a substrate 3 to be printed. Thus it is possible to get an indication on how big the obstruction 25 is, because the bigger the obstruction 25, the more the flap 14 gets elastically moved by bending in the y-direction, and the more the light beam 22 gets blocked by the tapering opening 40.

Besides the shown embodiments all kinds of variants are possible. For example instead of flaps it is also possible to use rigid sub-detection elements that are movable relative to a sub-frame by means of rotation around hinges or that are movable relative to a sub-frame because of flexible connections therewith. Instead of having the sub-detection elements extending downwards towards the substrate holder in the vertical direction, it is also possible to use the invention for other orientations, like for example slanted ones along a curved path of a substrate to be printed, or even upside down when that is desired.

Thus according to the invention a printing system is provided with an optimized detection mechanism with individually movable sub-detection elements that can be manufactured in an economic manner, that is reliable during use in such a way that the expensive printheads can be optimally protected against all kinds of obstructions that otherwise may crash against them.

The invention claimed is:

1. A printing system comprising:

a print module with one or more printheads covering a printing width in an x-direction; and a substrate holder for supporting a substrate to be printed on by the print module;

wherein the substrate and print module are movable relative to each other in a y-direction that is perpendicular to the x-direction, wherein each printhead in a print position is positioned spaced at a first distance from the substrate holder in a z-direction that is perpendicular to the x- and y-direction, wherein a detection mechanism is provided for detecting obstructions on the substrate holder, like crumples in the substrate, the detection mechanism comprising a detection element that extends along the printing width, and that, in the print position, is positioned spaced at a second distance from the substrate holder in the z-direction, which second distance is smaller than the first distance, wherein a control unit is provided for stopping further relative movement in the y-direction between the substrate and the print module when an obstruction has been detected by the detection mechanism, wherein the detection element of the detection mechanism comprises at least a first set of individually movable sub-detection elements that are positioned adjacent each other or staggered along the printing width for together cover the printing width in the x-direction, and wherein the individually movable sub-detection elements are designed to have a detection signal send out to the control unit when one of the sub-detection elements gets moved out of a starting position by an obstruction trying to pass it.

2. The printing system according to claim 1, wherein the individually movable sub-detection elements are formed by flexible flaps that extend in the x-z-plane and that are elastically deformable in the y-direction.

3. The printing system according to claim 1, wherein the detection mechanism further comprises a sensing organ that extends in the x-direction along a plurality of the individually movable sub-detection elements such that the sensing organ gets activated or de-activated as soon as one of the sub-detection elements gets moved by an obstruction trying to pass it.

4. The printing system according to claim 3, wherein the sensing organ comprises a light transmitter, in particular a laser, and a light sensor, wherein the light transmitter is positioned for transmitting a light beam in the x-direction along the plurality of the individually movable sub-detection elements towards the light sensor such that the light beam gets at least partly interrupted as soon as one of the sub-detection elements gets moved by an obstruction trying to pass it.

5. The printing system according to claim 3, wherein each individually movable sub-detection element comprises an activating or de-activating part that projects in the y-direction and that is designed for activating or de-activating the sensing organ.

6. The printing system according to claim 5, wherein each individually movable sub-detection element is plate shaped extending in the x-z-plane, and wherein the activating or de-activating part is formed by a part that has been partly cut-out of the plate-shaped element and bent towards the y-direction.

7. The printing system according to claim 5, wherein each activating or de-activating part comprises an opening, and wherein the sensing organ in the starting positions extends through the openings of the plurality of the individually movable sub-detection elements.

8. The printing system according to claim 7, wherein each activating or de-activating part has the opening centrally provided inside it.

9. The printing system according to claim 7, wherein the opening seen in the y-direction gradually decreases its dimension in z-direction.

10. The printing system according to claim 1, wherein the individually movable sub-detection elements are made out of plastic, in particular polypropylene foil.

11. The printing system according to claim 1, wherein the first set of individually movable sub-detection elements has its sub-detection elements positioned adjacent each other in a row, and in particular fixedly connected to a beam that extends in the x-direction.

12. The printing system according to claim 11, wherein a height adjustment mechanism is provided for adjusting a position in z-direction of the first set of individually movable sub-detection elements relative to the substrate holder and/or relative to the print modules.

13. The printing system according to claim 1, wherein the first set of the individually movable sub-detection elements is provided at a side of the print module that is directed towards a direction of relative movement between the print module and the substrate holder.

14. The printing system according to claim 1, wherein the print module is placed on a carriage that is movable back and forth in the y-direction along the substrate holder during printing of a substrate.

15. The printing system according to claim 14, wherein the first set of the individually movable sub-detection elements is provided at one of the transverse sides of the carriage that extends in the x-direction.

16. The printing system according to claim 15, wherein a second set of the individually movable sub-detection elements is provided at the other opposing transverse side of the carriage that extends in the x-direction.

* * * * *